United States Patent [19]

Onishi et al.

[11] Patent Number: 5,028,958

[45] Date of Patent: Jul. 2, 1991

[54] COPYING APPARATUS WITH SIMULTANEOUS MULTI-COLOR SINGLE CYCLE COPYING

[75] Inventors: Takashi Onishi; Hiroyuki Hanamoto, both of Osaka, Japan

[73] Assignee: Minolta Camera Kabishiki Kaisha, Osaka, Japan

[21] Appl. No.: 233,031

[22] Filed: Aug. 17, 1988

[30] Foreign Application Priority Data

Aug. 21, 1987 [JP] Japan ..... 62-209007
Aug. 21, 1987 [JP] Japan ..... 62-209008

[51] Int. Cl.[5] ..... G03G 15/01; G03G 21/00
[52] U.S. Cl. ..... 355/210; 355/326
[58] Field of Search ..... 355/245, 251, 253, 326, 355/327, 328, 210

[56] References Cited

U.S. PATENT DOCUMENTS 3,914,043 10/1975 McVeigh ..... 355/326
3,960,445 6/1976 Drawe ..... 355/326
4,685,794 8/1987 Watanabe ..... 355/218
4,897,697 1/1990 Ito et al. ..... 355/245

FOREIGN PATENT DOCUMENTS 61-203474 9/1986 Japan ..... 355/245

*Primary Examiner*—Fred L. Braun
*Attorney, Agent, or Firm*—Burns, Doane, Swecker & Mathis

[57] ABSTRACT

A copying machine has a simultaneous color mode for forming multi-color images in a single copy cycle and especially selects and releases the simultaneous color mode. An index, which is movable in the scanning direction of a document, is operated to automatically select the simultaneous color mode and set the switching position thereof. In addition, the index is moved out of a document area to automatically release the simultaneous color mode, which enables the simultaneous color mode to be easily selected and released. As a result, the miscopying of a document caused by a mistaken operation in selecting or releasing the simultaneous color mode can be prevented.

17 Claims, 10 Drawing Sheets

COPYING APPARATUS WITH SIMULTANEOUS MULTI-COLOR SINGLE CYCLE COPYING

BACKGROUND OF THE INVENTION

1. Field of the Invention

The present invention relates to a copying machine having a simultaneous color copying function which forms multicolored images in a single cycle, and more particularly to a copying machine in which it is easy to select and release a simultaneous color mode.

2. Description of the Prior Art

A copying machine which in a single copying cycle switches a plurality of developing units to perform multicolored copying, is disclosed in the Japanese Patent Appln. Laid-Open No. 203474/1986.

Such a copying machine requires a selecting means for selecting or releasing the simultaneous color mode and an indicating means for indicating the position of a document where developing units are switched.

For example, the selecting means uses a selecting key switch disposed on a console panel, the key switch, each time it is depressed, switches alternately the selection and release of simultaneous color mode and the indicating means uses a ten-key for inputting numerical values, so that it is suggested that the ten-key numerically inputs the switching position.

In such a method, however, when the simultaneous color mode carries out copying operation, the switching position must be inputted by the ten-key after the key switch selects the simultaneous color mode and two kinds of operations are required, thereby creating the problem that the numerical input by the ten-key is hard to directly confirm the switching position on the document. It is suggested that an area indicating lever, which is movable along the lateral side of a document table and in the scanning direction, can be provided instead of the numerical input by the ten-key and movably operated to indicate the switching position. Also, in this case, when the copying action is carried out in the simultaneous color mode, two kinds of operations are also required, the same as the above-mentioned case, and the operation becomes troublesome.

In both of the above-mentioned cases, it is required for releasing the simultaneous color mode to positively operate the selecting key switch. If this operation is neglected, the next operator carries out by mistake the simultaneous color mode copying although it should not be so, thereby creating the problem that miscopying may occur.

SUMMARY OF THE INVENTION

In order to solve the above problems, the present invention has been designed. A copying machine thereof is provided with an indicating means which sets the simultaneous color mode and also indicates a color switching position, and a releasing means which releases the simultaneous color mode when the indicating means is in the standard position out of the area of the document.

Accordingly, a first object of this invention is to provide a copying machine which can facilitate selection and release of the simultaneous color mode.

A second object of this invention is to provide a copying machine which can prevent the occurrence of miscopying in accordance with a mistaken operation in selecting or releasing the simultaneous color mode.

A third object of this invention is to provide a copying machine which is provided with a releasing means for releasing the simultaneous color mode at the point of time when a series of copying operations with respect to one sheet of a document has finished so that there is no fear that the next operator performs by mistake the simultaneous color mode copying operation.

The above and further objects and features of the invention will more fully be apparent from the following detailed description with accompanying drawings.

DESCRIPTION OF THE PREFERRED EMBODIMENTS

Next, an embodiment of a copying machine of the invention will be described with reference to the accompanying drawings.

Figure 1:
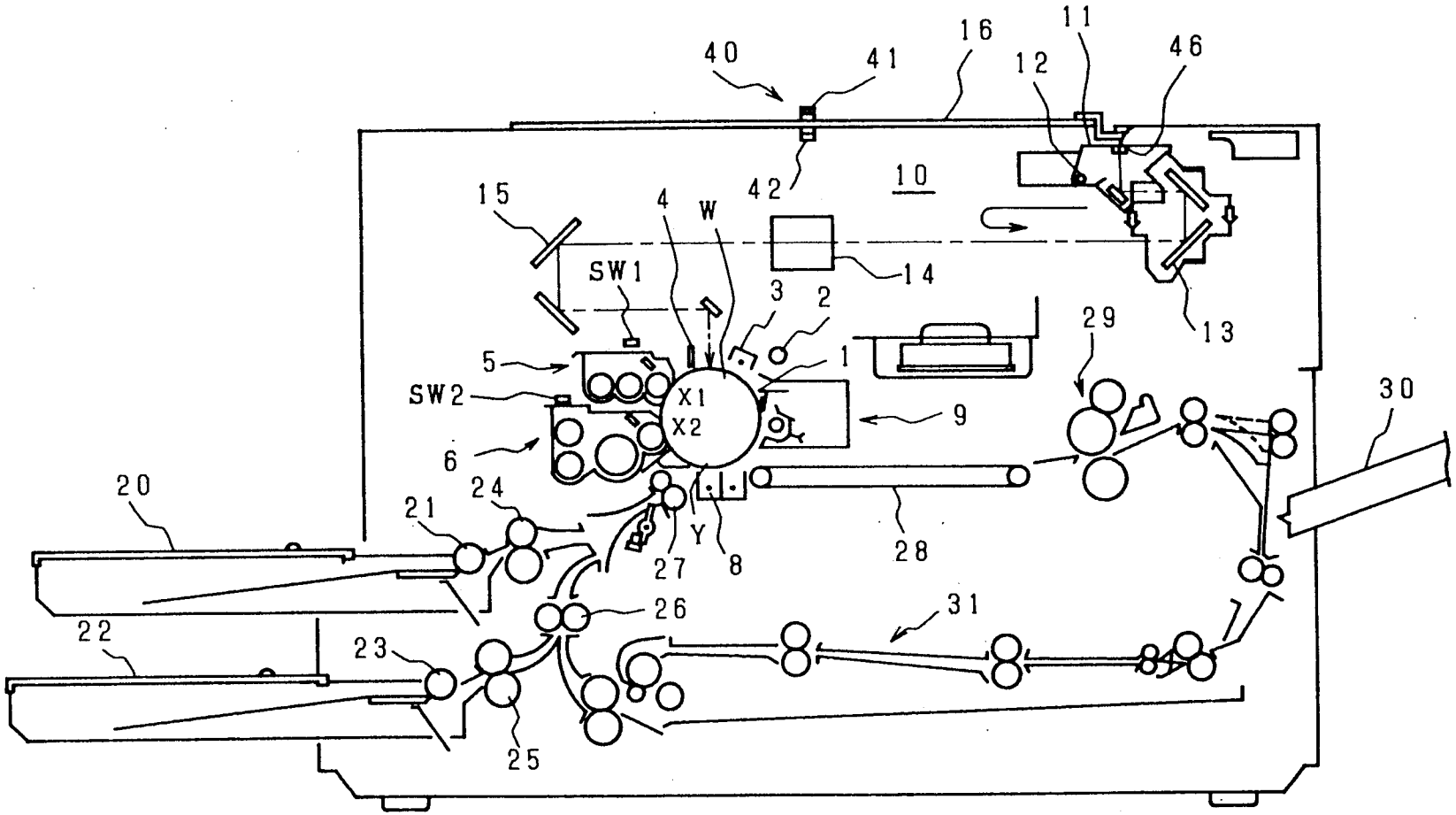
FIG. 1 is a sectional view of schematic structure of a copying machine of the invention.
Figure 2:
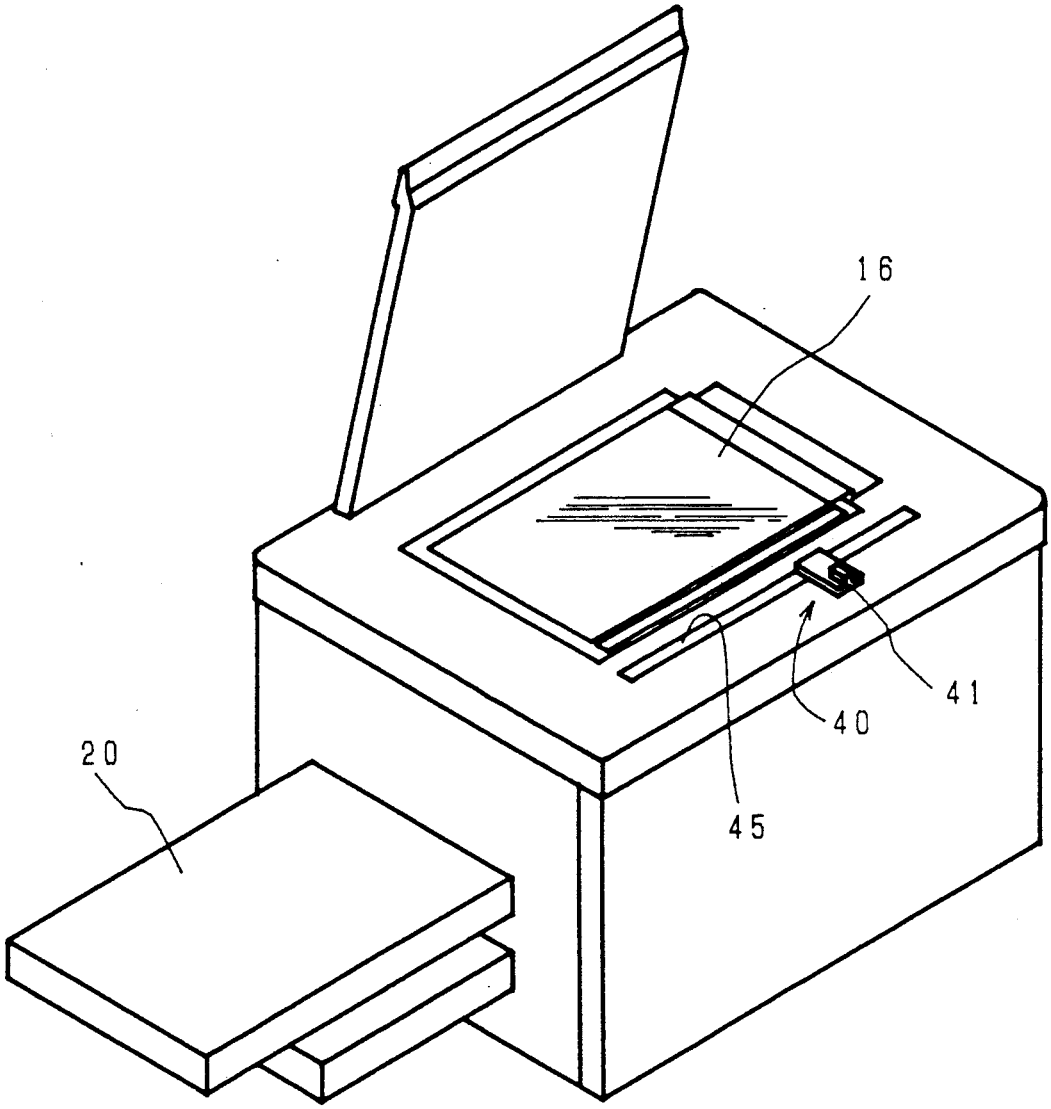
FIG. 2 is a perspective exterior view thereof.
Figure 3:
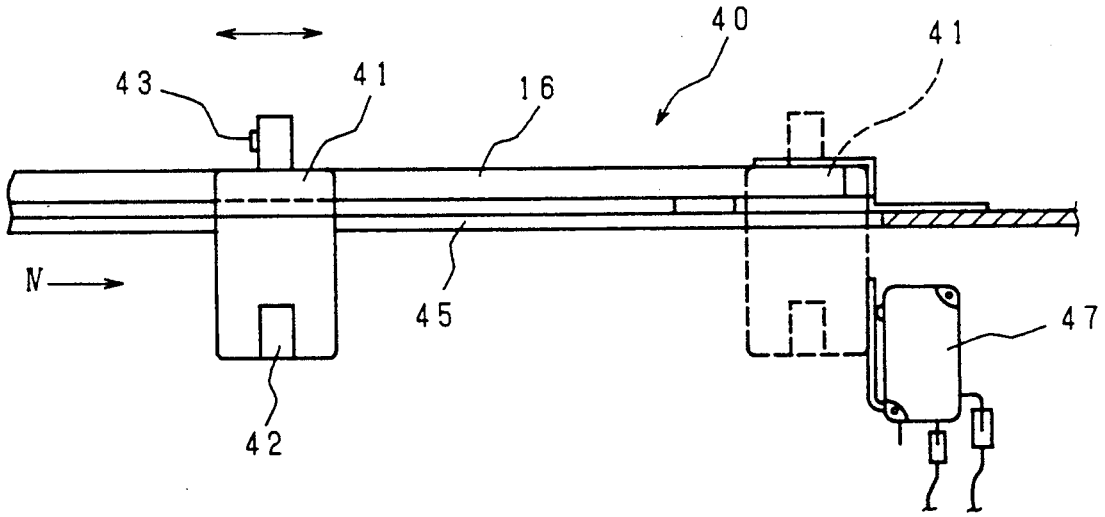
FIG. 3 is an enlarged sectional view showing each part of an area specifying device thereof.
Figure 4:
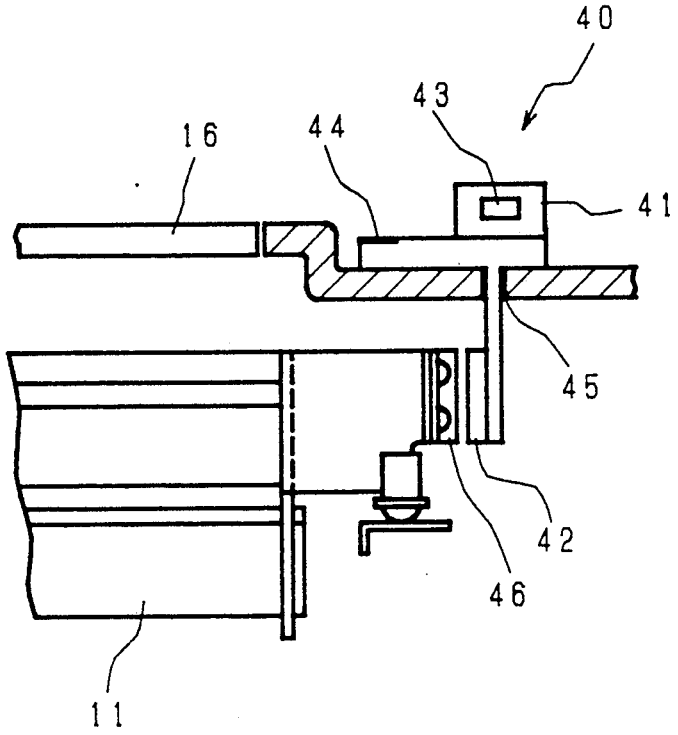
FIG. 4 is a sectional view taken on the line IV in FIG. 3.
Figure 5:
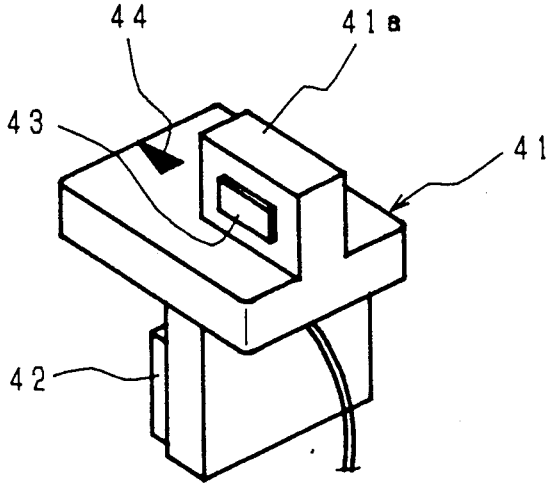
FIG. 5 is a perspective view of a lever at the same.

FIG. 1 is a schematic sectional front view of the structure of the copying machine of the invention.

In the same drawing, at an approximately central portion of a body of the copying machine is disposed a photosensitive drum 1 rotatably driven counterclockwise, around which are provided an eraser lamp 2, a charger 3, an interimage eraser lamp 4, an upper developing unit 5, a lower developing unit 6, a transfer charger 8, a cleaning unit 9 and the like. The photosensitive drum 1 is provided at the surface thereof with a photosensitive layer and is uniformly charged by passing through the charger 3 and receives at an exposure point W the image exposure from an optical system 10.

The optical system 10 is provided to enable scanning of the document image under the document table 16, and is comprised of a scanner 11 equipped with an exposure lamp 12 of a light source and a mirror 13, a lens 14, a mirror 15 and the like.

Two upper and lower paper feeders 20 and 22 provided with paper feeder rollers 21 and 23, respectively are installed at the left side of the copying machine body, copy paper selectively fed from the paper feeder 20 or 22 passes a transport route comprised of a copying area Y constituted by a pair of rollers 24, pairs of rollers 25 and 26, a pair of timing rollers 27, and a transfer charger 8; a transport belt 28; and a fixing unit 29; and is copied and then discharged to a discharger 30.

A duplex device 31, when the double-sided copying, composite copying, and image edition copying, discussed below, are performed, is charged with the copy paper once passed the aforesaid transport route, and then refed to pass again the transport route, thereby performing twice copying operations on both side or one side of the copy paper.

The upper developing unit 5 and the lower developing unit 6 are switched on the way to be operated with respect to a single scan operation by the scanner 11, whereby a single copying operation (by one shot) can form dichroic (two colors) images. Such a copying operation will hereinafter be called the simultaneous color copying or merely simultaneous color.

An area specifying device 40, when performing the simultaneous color copying, sets the boundary of two colors to specify the area of each color and also carries out selection and release of the simultaneous color mode.

Referring to FIGS. 2 through 5, a lever 41 is provided which is slidable in a slide groove 45 in the scanning direction of the scanner 11 on the surface at the lateral side of the document table 16. A permanent magnet 42 is mounted on the lateral side of the lower portion of lever 41, an index 44 is provided at the utmost end of the upper surface of lever 41, and at a lug 41*a* of lever 41 is provided a detecting switch 43 which is on by holding the lug 41*a* so as to move the lever 41 to thereby output a signal for selecting the simultaneous color mode. The detecting switch 43 is of a lighting type and outputs an on-signal when depressed, and also when the simultaneous color mode is selected by the switch 43, a simultaneous color display 76, discussed below, and the surface of detecting switch 43 are lit.

A reed switch 46 is provided at the scanner 11 and magnetically responds by the permanent magnet 42 to the scanner 11 during the scanning so as to detect the position of lever 41, thereby outputting a signal for switching the upper and lower developing units 5 and 6.

At the standard position of the end of the slide groove 45 at the start point in the scanning direction is provided a standard position detecting switch 47 which detects that the lever 41 is positioned out of the document area in the scanning direction and outputs a signal for releasing the simultaneous color mode. The standard position detecting switch 47 is switched on by moving the lever 41 to the standard position by the operator, and off by moving the lever 41 in the document area apart from the standard position by the operator.

In addition, the upper and lower developing units 5 and 6 are detachably mounted on the position shown in FIG. 1, mounting or dismounting of which is detected by switches sw1 and sw2. Detecting sensors (not shown) provided in the developing units 5 and 6 detect whether or not toner in each developing unit 5 or 6 is empty so that the detection signal is adapted to be inputted in a second CPU 202, discussed below. Also, the color of the toner for each developing unit is adapted to be detected by each switch (not shown). In the present embodiment, the upper developing unit 5 is red, the lower developing unit 6 is black.

Figure 6:
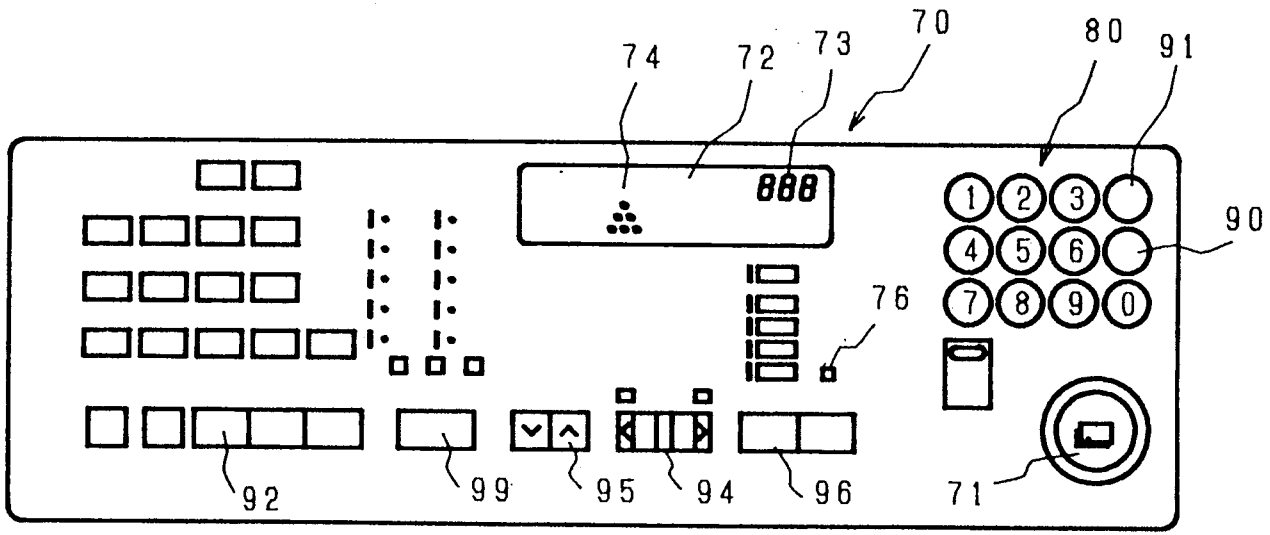
FIG. 6 is a front view of a console panel of the same.

FIG. 6 shows a console panel 70 at the copying machine. A print start key 71 for starting the copying operation, a display unit 72 comprising a numerical display 73 and a toner-empty display 74, a simultaneous color display 76 which displays that the simultaneous color mode is selected, a ten-key 80, an interrupt key 90, a clear stop key 91, a fixed scale factor setting key 92, a concentration adjusting key 94, a zoom key 95, a color specification key 96 for specifying developing color, and a paper selecting key 99 are situated on the console panel 70.

Figure 7:
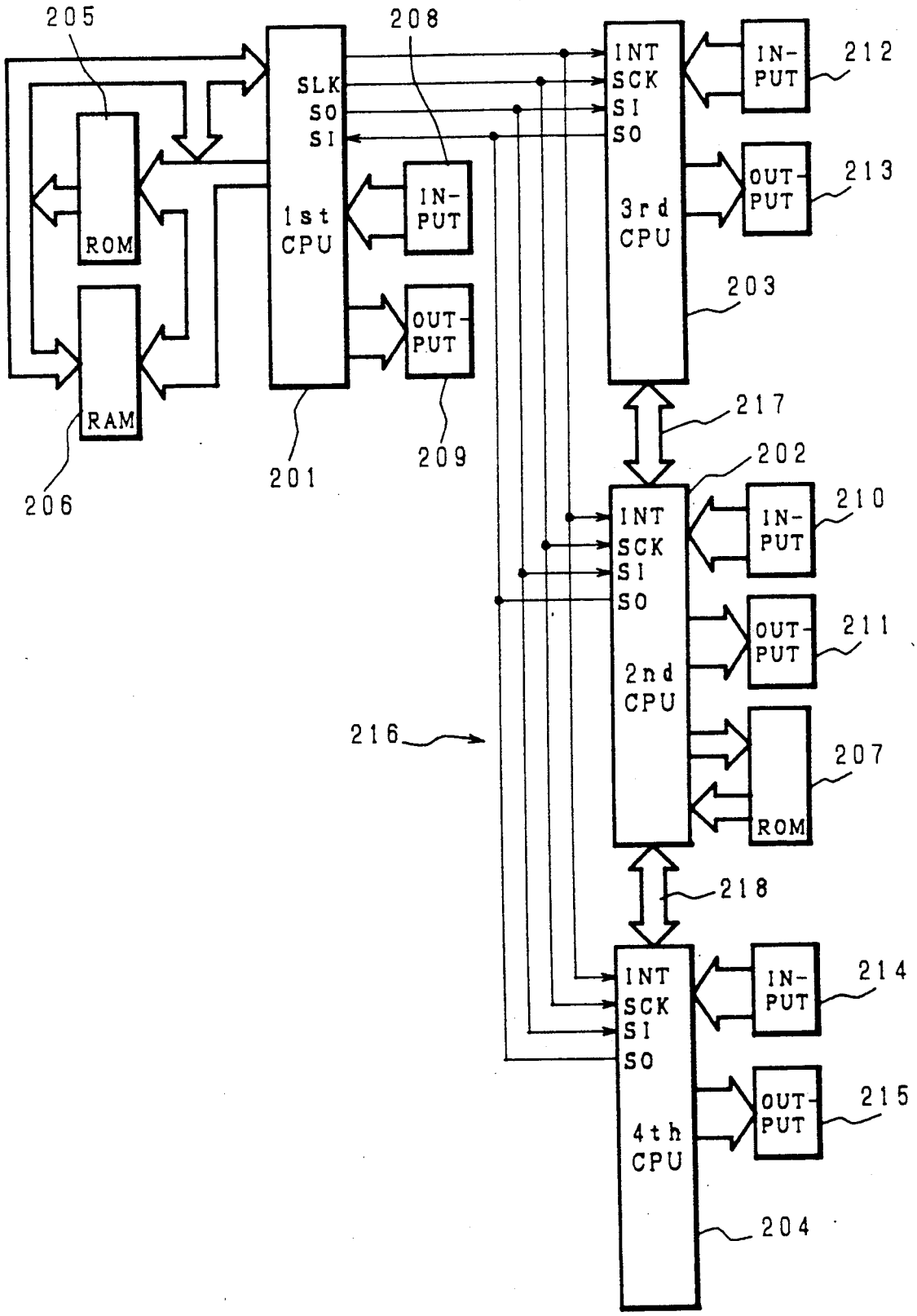
FIG. 7 is a block diagram of a control circuit at the same.

FIG. 7 is a schematic structural view of a control circuit of the copying machine of the invention.

As shown in FIG. 7, the control circuit is provided with CPUs 201 through 204.

The first CPU 201 performs input/output of each key on the console panel 70 and data exchange by serial communication through a communication line 216 between the CPU 201 and other CPUs 202 through 204 and other optional CPU (not shown), thereby controlling as the host CPU the entire system.

The second CPU 202 detects toner-empty when a signal is inputted from the aforesaid sensor (not shown) and also controls the interimage eraser lamp 4 or an image formation processes, such as paper feed, image formation and fixing.

The third CPU 203 controls the optical system 10, such as lens position or scanner speed. The fourth CPU 204 controls the double-sided copying and composite copying, and the position of the regulating plate to meet with switching of the double-sided copying and composite copying operations or the size thereof.

Between the second CPU 202 and the third CPU 203 and between the second CPU 202 and the fourth CPU 204, other than the aforesaid serial communication, data exchange by parallel communication is performed through the communication lines 217 and 218. Programs required to control are stored in ROMs 205 and 207, RAM 206 storing the needed data and program.

Next, an explanation of the simultaneous color will be given. The simultaneous color, as above-mentioned, is adapted to form the images of two colors in a single copying operation. The simultaneous color mode is selected by a signal from a detecting switch 43 provided at the lever 41 and released by a signal from a standard position detecting switch 47. When both of the signals are simultaneously inputted, the signal from the standard position detecting switch 47 is prior, thereby releasing the simultaneous color mode. In the simultaneous color mode of the present embodiment, the image on one document is divided into two parts at the position of the lever 41 in the scanning direction of the scanner 11, a first half image is copied in color (in red) and a latter half one in black.

Figure 8:
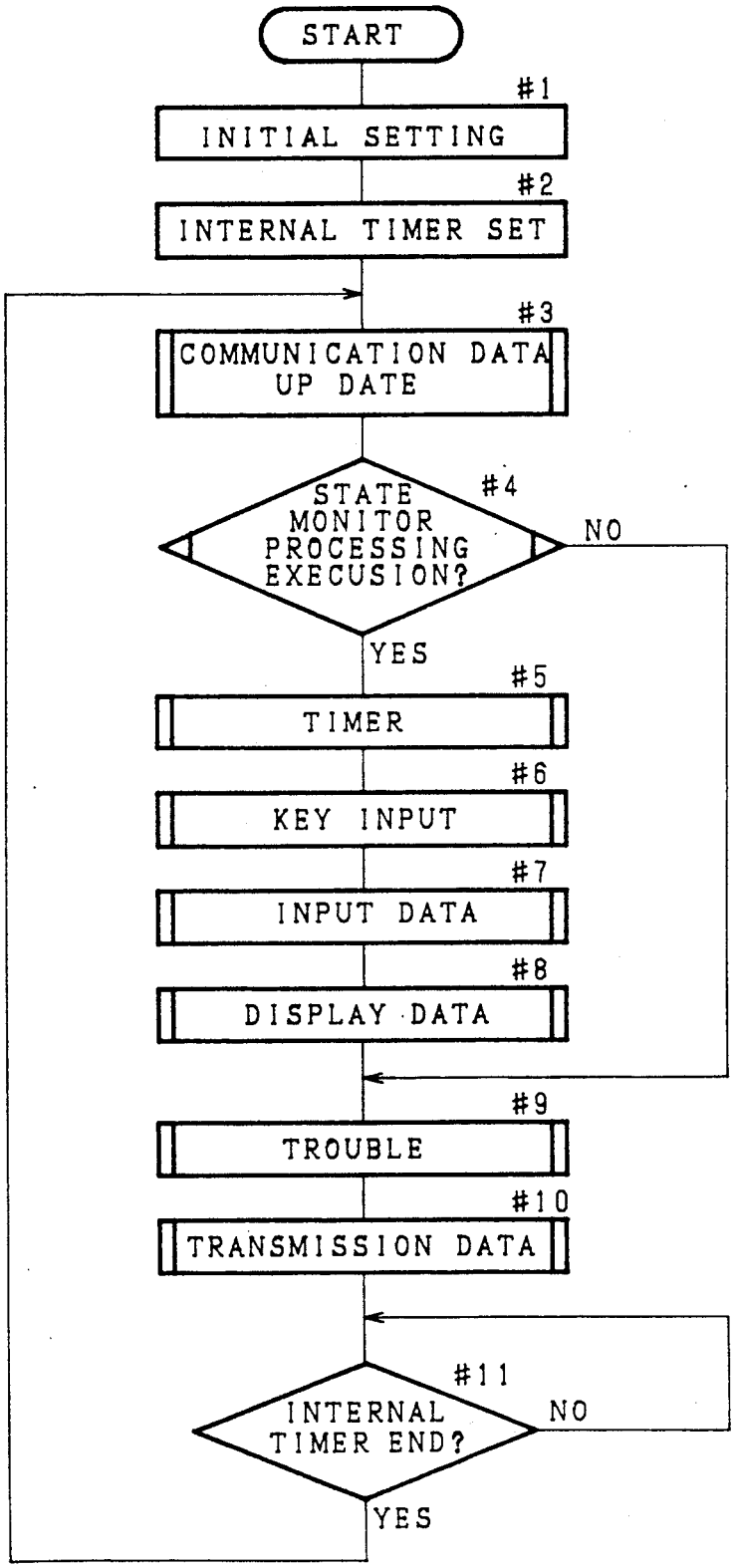
FIGS. 8 through 11 are flow charts showing control operation of the same.

Next, the procedure of copying operation will be detailed in accordance with flow charts in FIGS. 8 through 10 as follows:

FIG. 8 is a flow chart of schematically showing the processing by the first CPU 201.

When a power source is closed to start the program, at step #1 part or the whole of content of RAM 206 is cleared corresponding to the internal state of CPU 201 or initialization of an output port and the state of an initial switch (not shown), thus initializing all the control objects. At step #2, an internal timer for specifying a length of a main routine is set. At step #3, with regard to the serial communication data, the received data is transferred to an internal-processing RAM and the processed transmitting data to RAM for transmission buffer. At step #4, the condition of copying machine is judged to decide whether or not the next series of processing is executed.

Next, at step #5, all timers for mechanical control and counting up at every single main routine are counted-up and, when the counting ends, the processing corresponding to each timer is executed. At step #6, input is introduced from each key at the console panel 70 and the switch related the area specifying device 40 and the processing corresponding to the content of the above is carried out. Therefore, at step #7, the processing corresponding to received data is executed, at the step #8, the data displayed on the console panel 70 is updated, at the step #9, the processing corresponding to the trouble information received from other CPUs 202 through 204, and at step #10, data to be transmitted is processed.

At step #11, the previously set internal timer is queued, and when the internal timer is finished, the abovementioned main routine is again executed.

Figure 9:
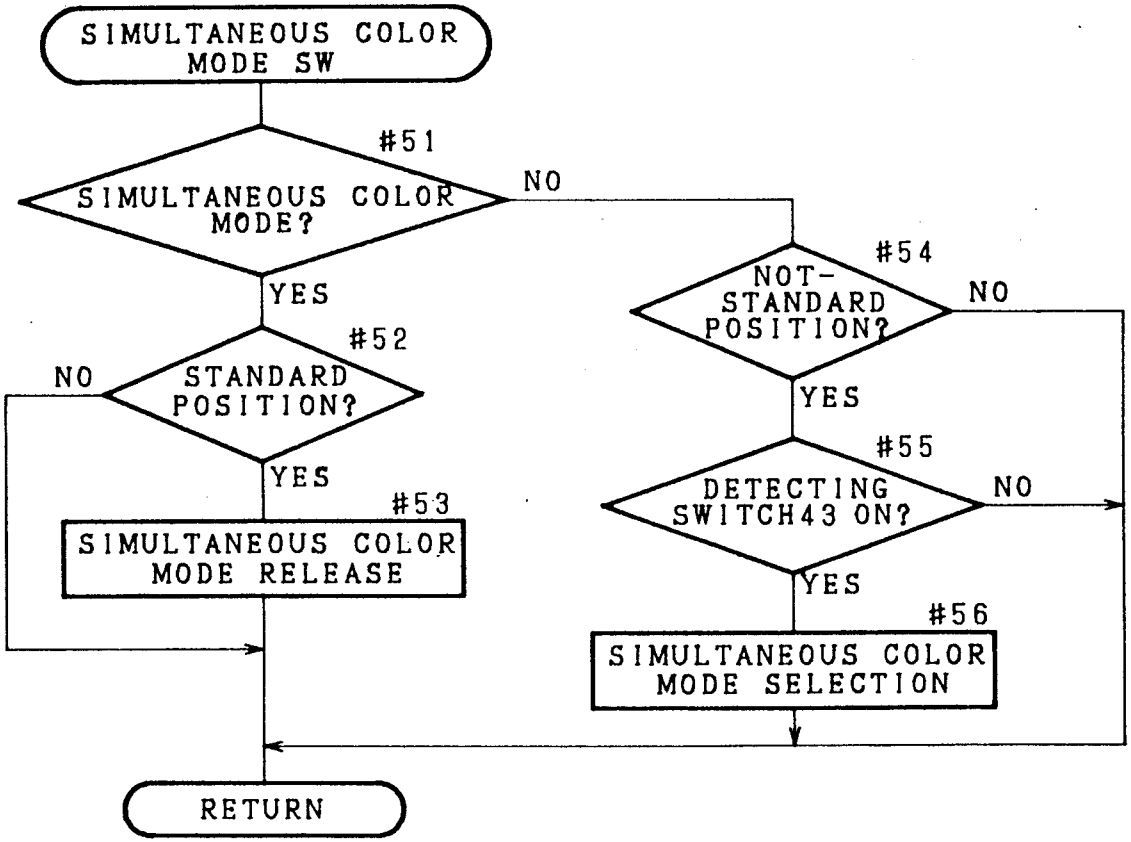

FIG. 9 is a flow chart of a subroutine, showing in detail part of the key input routine at step #6 in FIG. 8.

At step #51, it is decided whether or not the present state is in the simultaneous color mode, and if it is in the simultaneous color mode, then at step #52, it is decided by the existence of the signal from standard position detecting switch 47 whether or not the lever 41 is in the standard position. If the lever 41 is positioned so (yes at step #52), then the simultaneous color mode is released.

When the present state is not the simultaneous color mode, if the lever 41 is not in the standard position and signal from the detecting switch 43 is on (yes at steps #54 and 55) then, the simultaneous color mode is selected at step #56.

Figure 10:
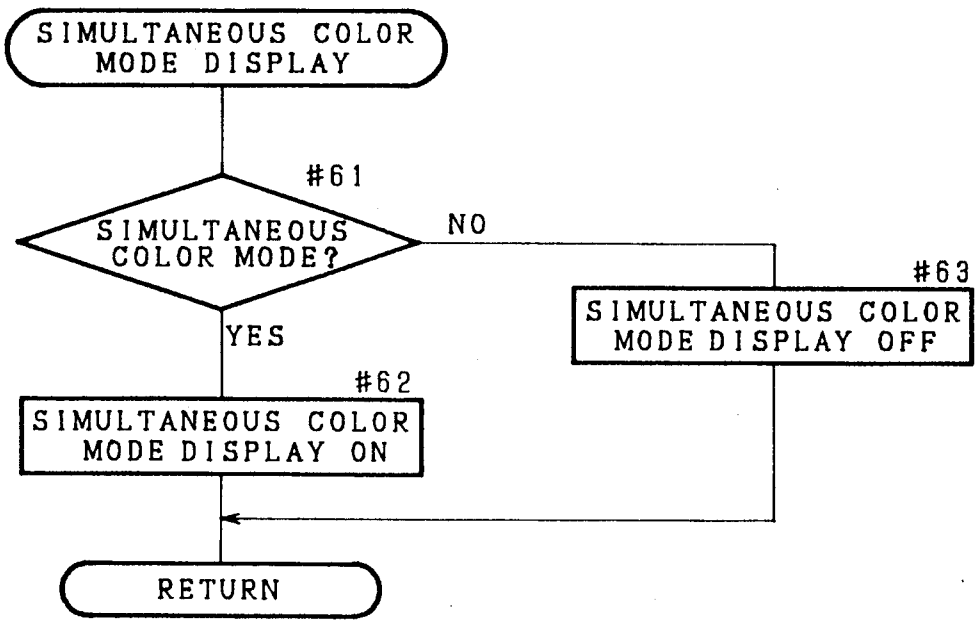

FIG. 10 is a flow chart of the subroutine showing in detail part of the display data routine at step #8 in FIG. 8.

At step #61, it is decided whether or not the present state is the simultaneous color mode, if so, the lighting signal of the simultaneous color display 76 is turned on (at step #62), and if not so, the signal is off (at step #63).

According to the above-mentioned embodiment, when the simultaneous color mode is selected, the lug 41*a* at the lever 41 is held with the operator's fingers to merely move the lever 41 to a desired switching position, whereby the detecting switch 43 is switched on to select the simultaneous color mode and also the switching position is indicated due to the position of lever 41.

The lever 41 is moved to the standard position so that the standard position detecting switch 47 is switched on, thereby releasing the simultaneous color mode from its selected state.

In the state where, in spite of the fact that the lever 41 is positioned apart from the standard position, the simultaneous color mode is released by the all clear, when the copying operation is carried out in the normal mode and not in the simultaneous color mode, the lever 41 is not operated, or need only be moved to the standard position.

In a case where one document is copied by selecting the simultaneous color mode and another document is copied thereby, the lever 41 is moved to reindicate the switching position for another document, thereby enabling continuous copying operation in the simultaneous color mode. In this case, lever 41 need not be moved when no switching position is changed, but generally when a document changes, the switching position may often be changed. Hence, even when the simultaneous color mode is released by the all clear, the movement of lever 41 reselects the simultaneous color mode.

In brief, in any case mentioned above, a single operation of picking the lever 41 can select and release the simultaneous color mode, whereby the embodiment of the copying machine of the invention is extremely superior in operability.

In the above-mentioned embodiment, the simultaneous color mode is released when the lever 41 is returned to the standard position and when the auto-clear is carried out with the lapse of predetermined time in condition of using no copying machine, but the simultaneous color mode may be released even when one sheet of a document is completed copying. The time when one sheet of a document is completed copying is that, for example, after a while from a finish of copying operation, when a holder cover for the document is open, when the multi-copying finishes, and a signal for exchanging the document during the use of ADF (automatic document feeding device) is outputted.

Figure 11:
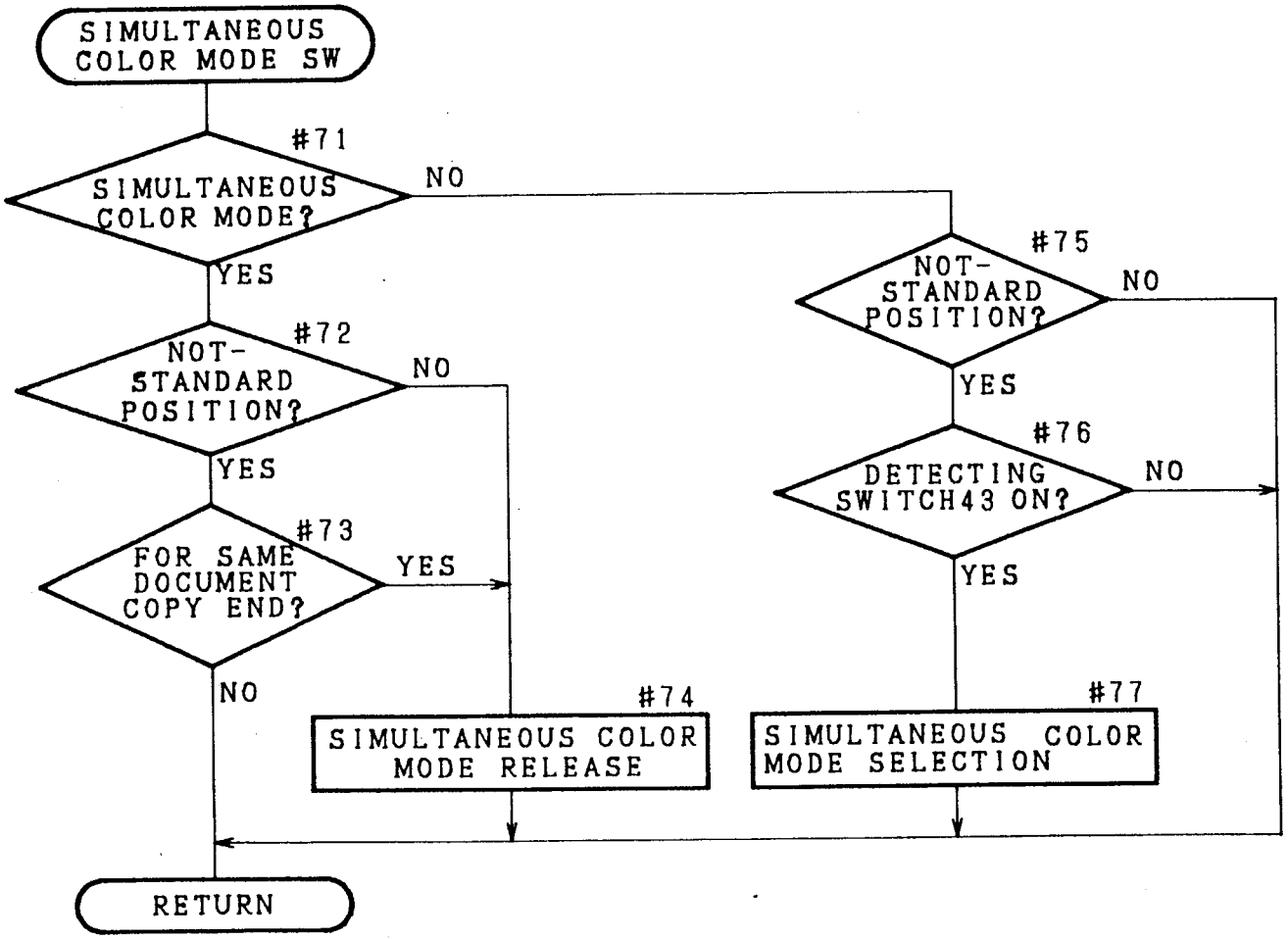

FIG. 11 is a flow chart of a subroutine in the above case, showing in detail part of key input routine at the step #6 in FIG. 8.

At step #71, it is determined whether or not the present state is in the simultaneous color mode. If it is in the simultaneous color mode, the existence of the signal from the standard position detecting switch 47 determines whether or not the lever 41 is in the standard position (step #72). If the lever 41 is not in the standard position (yes at step #72), then it is decided whether or not the copying operation with respect to the same document is completed (step #73). When the copying operation thereto is not completed (no at step #73), the lever 41 directly returns to continue the simultaneous color mode. When the copying operation with respect to the same document is completed (yes at step #73), the simultaneous color mode is released (step #74).

In a case where no simultaneous color mode is decided at step #71, if the lever 41 is not in the standard position and signal from the detecting switch 43 is on (yes at the steps #75 and 76), the simultaneous color mode is selected (step #77).

When the copying operation for one sheet of the document unfinished, the simultaneous color mode is released, so that even when operation for release is not carried out, the next document can be copied in a usual mode.

In such a case, there is no fear that the next operator copies by mistake the document in the simultaneous color mode. Moreover, even when the copying operation in the simultaneous color mode is continued, since the switching position usually changes when the document changes, the lever 41 is again moved to enable the simultaneous color mode to be selected with ease, thereby keeping the operability proper.

Alternatively, the above-mentioned embodiment may use a photosensor in place of the reed switch 46 and a shade instead of the permanent magnet 42 for shading the photosensor. The detecting switch 43 may be provided at both sides of the lug 41*a* and various kinds of switches or sensors may be used as the detecting switch 43 or standard position detecting switch 47. For example, a push button switch, a limit switch, a proximity sensor, a touch sensor, a photosensor, a magnetic sensor, a pressure sensitive sensor or the like.

In the above-mentioned embodiment, a single lever 41 is provided and the developing unit is only once switched during the single simultaneous color copying operation, but two or more levers 41 may alternatively be provided and the developing unit may twice or more be switched. In this case, for example, when three levers are provided at one slide groove 45, the detecting switch 43 may be provided at only the lever farthest from the standard position and the lever only is detected whether or not it is in the standard position. The reason for this is that when the simultaneous color mode is selected, the lever farthest from the standard position must be moved therefrom and also when the lever is returned to the standard position, all the levers return thereto. Also, even when a slide groove 45 is provided at every lever, the lever to be standard is predecided, in which the same matter as the above can be said.

In the aforesaid embodiment, the upper developing unit is of red color, but may be of other colors, for example, yellow or green. The lower developing unit is of black color, but also may be of other colors. Also, both the upper and lower developing units may be disposed reversely and may be of various structures.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds there of are therefore intended to be embraced by the claims.

What is claimed is:

1. A copying machine comprising;
a document table;
a photosensitive member;
a scanning means for scanning a document on said document table;
a means for forming electrostatic latent images on said photosensitive member on the basis of images of said document scanned by said scanning means;
a plurality of developing means for developing said electrostatic latent images on said photosensitive member by use of toner of different colors respectively;
an indicating means which is movable in the scanning direction of said document, sets a simultaneous color mode performing developing operation by switching said developing means during the developing of one of said electrostatic latent images, indicates the switching position, and has a standard position out of an area where said document on said document table is to be placed; and
a releasing means for releasing said simultaneous color mode in a moment of detecting that said indicating means is in said standard position.

2. A copying machine according to claim 1, further comprising a means for setting a monochrome color mode performing developing operation by one of said plurality of developing means.

3. A copying machine according to claim 1, wherein said indicating means has a lever movable in the scanning direction of said document, and a simultaneous color mode setting switch provided at part of said lever.

4. A copying machine according to claim 3, wherein said part of said lever is a lug thereof.

5. A copying machine according to claim 3, wherein said simultaneous color mode setting switch has a display unit displaying that said simultaneous color mode is set.

6. A copying machine according to claim 3, wherein said simultaneous color mode setting switch is one selected from a group comprising a push button switch, a limit switch, a proximity sensor, a touch sensor, a photosensor, a magnetic sensor, and a pressure sensitive sensor.

7. A copying machine according to claim 3, wherein said one lever is provided so that said developing means is switched only once during the development of one of said electrostatic latent images.

8. A copying machine according to claim 1, wherein said releasing means has a standard position detecting switch which is on when said indicating means moves toward said standard position and off when said indicating means moves away from said standard position.

9. A copying machine comprising;
a document table;
a photosensitive member;
a scanning system which scans and exposes a document placed on said document table to form on said photosensitive member electrostatic latent images corresponding to images of said document;
a plurality of developing units containing therein toner of different colors from each other for developing said electrostatic latent images formed on said photosensitive member;
an index member movably provided in the scanning direction of said document to indicate the position where said plurality of developing units are switched;
a detector which detects a position of said index member and outputs a position signal for representing the position thereof; and
a control system which, when said index member is positioned within an area where said document on said document table is to be placed, switches said plurality of developing units corresponding to the position of said index member during the development of said electrostatic latent images formed by a single scan and exposure of said document, and, when said index member is positioned out of said area where said document on said document table is to be placed, makes operable only one of said plurality of developing units.

10. A copying machine according to claim 9 wherein said one index member is provided so that said developing units are only once switched during the development of said electrostatic latent images formed by a single scan and exposure of said document.

11. A copying machine according to claim 9, wherein more than two of said index member are provided so that said developing units are switched twice or more during the development of said electrostatic latent images formed by a single scan and exposure of said document.

12. A copying machine comprising;
a document table;
a photosensitive member;
a scanning means for scanning a document on said document table;
a means which forms electrostatic latent images on said photosensitive member on the basis of images of said document scanned by said scanning means;
a plurality of developing means which develop said electrostatic latent images on said photosensitive member by use of toner of different colors respectively;
a mode setting means for setting a simultaneous color mode which switches said plurality of developing means to develop said images during the development of one of said electrostatic latent images;
an indicating means for indicating the switching position of said plurality of developing means in said simultaneous color mode; and
a releasing means for releasing said simultaneous color mode when copying operation with respect to one sheet of said document in said simultaneous color mode has been completed.

13. A copying machine according to claim 12, further comprising a means for setting a monochrome color mode to develop said images by one of said plurality of developing means.

14. A copying machine according to claim 12, wherein said indicating means has an index member movable in the scanning direction of said document.

15. A copying machine according to claim 14, wherein said index member has a standard position out of an area where said document on said document table is to be placed, so that also when said index member is within said standard position, said simultaneous color mode is released.

16. A copying machine according to claim 14, wherein said mode setting means is operated by operation of said index member.

17. A copying machine according to claim 14, wherein said index member has a lever movable in the scanning direction of said document and said mode setting means is a switch provided at part of said lever.

* * * * *